United States Patent [19]

Godfrey et al.

[11] 4,422,758

[45] Dec. 27, 1983

[54] BORESIGHTING OF AIRBORNE LASER DESIGNATION SYSTEMS

[75] Inventors: Thomas E. Godfrey, Orange; Lovere A. Moesser, Diamond Bar, both of Calif.

[73] Assignee: The United States of America as represented by the Secretary of the Army, Washington, D.C.

[21] Appl. No.: 286,415

[22] Filed: Jul. 24, 1981

[51] Int. Cl.[3] ..... G01B 11/26; G01C 1/00

[52] U.S. Cl. ..... 356/152; 250/341; 356/5; 356/138

[58] Field of Search ..... 89/41 L; 244/3.13, 3.16; 356/141, 152, 153, 154, 138, 5; 250/342, 341

[56] References Cited

U.S. PATENT DOCUMENTS 4,139,769 2/1979 McCrum ..... 356/153

OTHER PUBLICATIONS

F. M. Dickey et al., *SPIE*, vol. 251, Optical Alignment, 1980.

*Primary Examiner*—S. C. Buczinski

*Attorney, Agent, or Firm*—Robert P. Gibson; William Sheehan; Norman L. Wilson, Jr.

[57] ABSTRACT

A method and apparatus is described for boresighting the sighting systems used with a 1.06 micrometer designator laser. The method enables boresighting visual direct view optics, TV, and forward looking infrared (FLIR) sights with respect to the laser itself, without the use of external targets. The laser beam is focused onto a refractory target in the boresight device, creating very briefly an incandescent hot spot which can be "seen" by all three sensors. The radiation from this hot spot is collimated by the boresight device optics and projected back into the sights exactly anti-parallel to the laser beam. By aligning the sight reticles with this hot spot, all three types of sights are aligned relative to the laser. Since the hot flash created by the laser energy is of such short duration, the alignment can be accomplished in flight where relative motion exists between the laser designator system and the boresight module. The apparatus disclosed includes a $CO_2$ laser alignment fixture and a reflective collimator with a phosphor thermal imaging disk for precision alignment of the laser input and FLIR output lines of sight of the boresight module.

2 Claims, 8 Drawing Figures

BORESIGHTING OF AIRBORNE LASER DESIGNATION SYSTEMS

BACKGROUND OF THE INVENTION

1. Field of the Invention

The invention relates, in general, to laser guided weapon systems and, more particularly, to boresighting a 1.06 micrometer designator laser to any or all of the three sighting systems used in the Target Acquisition Designation System (TADS) and proposed by Northrop Corp. for the YAH-64 aircraft.

2. Description of Prior Art

One of the major potential sources of error in laser guided weapon delivery is boresight misalignment between the laser designating a target and the sighting system being used to aim at the target. The TADS has visual direct view, day TV, and Forward Looking Infrared (FLIR) sights which must be aligned with respect to the laser. Thus, a single boresighting method and apparatus usable by all of these sighting systems would be desirable. Since the boresighting techniques must conform to the specific requirements of the system, examples of techniques used with other aircraft laser designator sighting systems are discussed to highlight the specific requirements of TADS. Some of the examples will also be shown schematically in drawings that follow, since they help understand the evolution of the present system. These sighting systems were expanded and improved upon in the development of the present boresighting method for the TADS.

The Stabilized Platform Airborne Laser (SPAL) built for the U.S. Army consists of a laser designator/ranger, a high resolution adaptive gate TV autotracker camera, and target acquisition laser spot tracker, all of which are mounted in a two-axis stabilized platform. SPAL is boresighted by retroreflecting the attenuated laser beam into the 1.06 micrometer sensitive silicon vidicon TV camera, then manually centering the electronic aim-reticle and video autotracker electronic null on the laser spot. Airborne on a UH-1 helicopter, SPAL designated tank targets at long range during the first successful Hellfire (laser spot seeker) missile firing tests in 1974 (See FIG. 1).

The AN/AVO-27 Laser Target Designator Set (LTDS) is a small, rear-cockpit-mounted unit designed to provide laser designation, surveillance, reconnaissance, forward air observer, and bomb damage recording capability for two-seat aircraft, such as the Northrup F-5B and F-5F. It consists of a 16 mm camera, a direct view telescope (4X and 10X), and high-power laser which is projected by a lens common to the visual telescope. The laser beam is aimed by the operator's thumbforce controller imputs to a gyrostabilized mirror. During laboratory testing, it was first proven that the aim-reticle of the visual telescope sight could be aligned on a visual flash generated by the laser beam, while the latter was being focused on a target in a test collimator. (See FIG. 2).

The Laser Augmented Target Acquisition/Recognition (LATAR) system includes a high resolution 4:1 optically-compensated zoom lens, an adaptive-gate TV autotracker camera, and a laser designator/ranger (or operator-selectable laser-spot tracker). All are mounted within a self-contained pod and coupled through a two-way optical joint to a common objective lens. The lens is mounted in a gyro stabilized head having a 300-degree spherical field-of-regard. LATAR has been successfully flight tested on F-5E and F-4E aircraft. The system was boresighted by illuminating a pinhole (drilled by the LATAR laser) in a target at the focal point of an auxiliary collimator telescope.

The Light Observation Helicopter Target Acquisition/Designation System (LOHTADS) has a FLIR video sensor and separate aperture laser designator rangefinder. It is aimed manually or automatically by an adaptive-gate video target tracker. Boresighting the FLIR sensor of LOHTADS while airborne was proposed to be accomplished by aligning on collimated radiation emitted from a "hot flash", the "hot flash" being generated by the laser at the focal point of a reflective telescope. (See FIG. 3).

SUMMARY OF THE INVENTION

It is an object of this invention to provide a simple, lightweight, accurate, and rapid inflight method of boresighting the daysights (direct view optics (DVO) and day TV) and the FLIR, by aligning them to the lase without use of external targets.

Another object of the invention is to eliminate long-term boresighting errors due to changes in mechanical and electrical components by a boresighting method which is readily completed prior to or during flight.

Briefly, the present invention uses a simple wavelength conversion process to convert refocused laser energy into both a visible and infrared source which permits alignment of all optical systems to the laser directly. The laser is fired into, and focused by, reflective boresight optiics to form an incandescent "hot flash" on a special target material. Although the hot flash disappears in microseconds, it can be viewed by all three imaging systems which align on the hot flash.

DETAILED DESCRIPTION

Some of the more recent efforts to align the boresights in military weapon systems are shown in FIGS.

Figure 1:
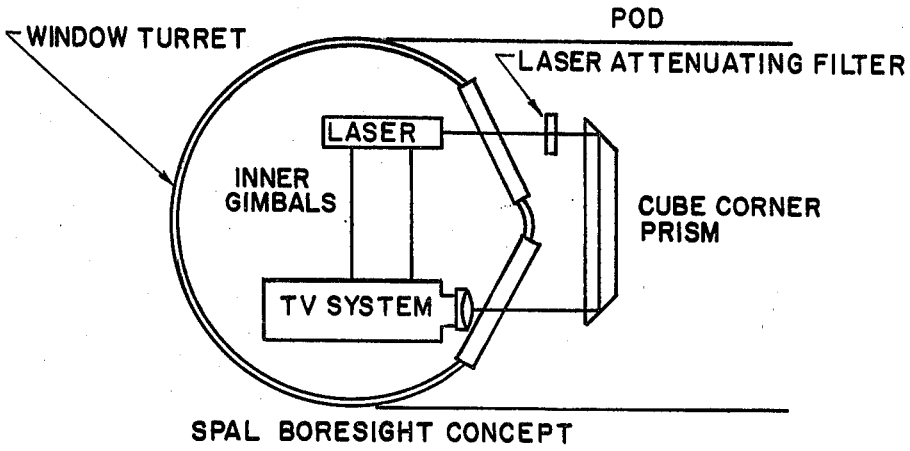
FIG. 1. PRIOR ART
FIG. 1 is a drawing of the Stabilized Platform Airborne Laser (SPAL) and it's cube corner boresight device discussed in the Background.
Figure 2:
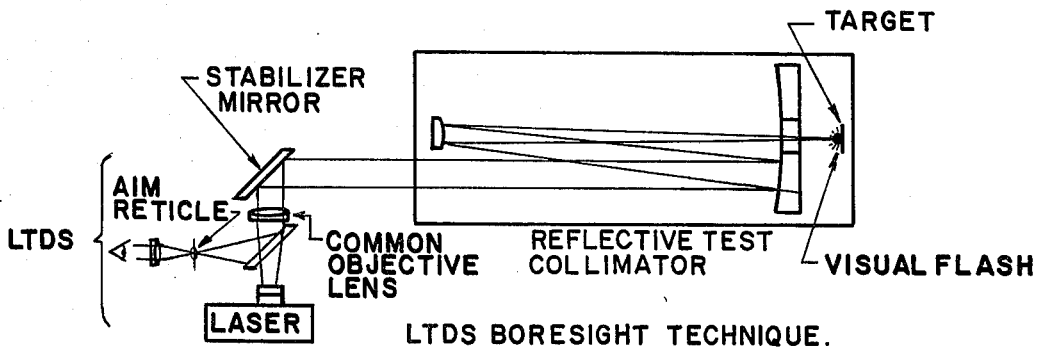
FIG. 2. PRIOR ART
FIG. 2 is a drawing of the Laser Target Designator Set (LTDS) and the reflective collimator use to boresight it, which were also discussed in the Background.
Figure 3:
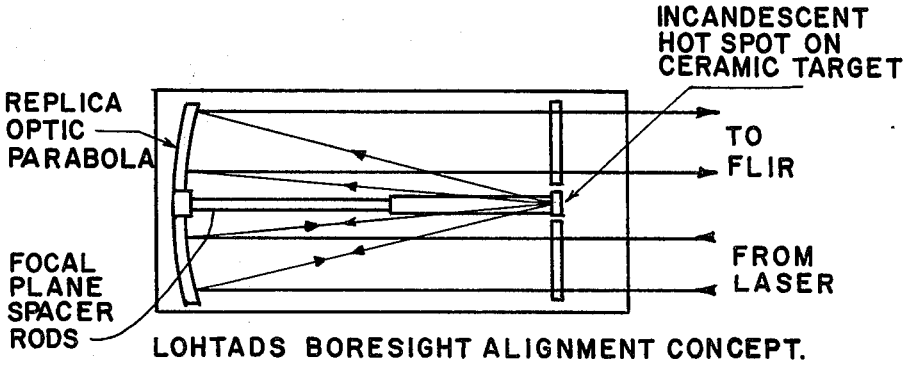
FIG. 3. PRIOR ART
FIG. 3 is a drawing of the boresight device proposed for the Light Observation Helicopter Target Acquisition/Designation System (LOHTADS) which is discussed in the Background.

1-3. The figures show various optical arrangement for some of the systems discussed as background and represent methods found not completely suitable for meeting the specific requirements for the Target Acquisition Designation System (TADS). The optical arrangements used in the SPAL, LTDS, and LOHTADS are shown in FIGS. 1-3 respectively. The discussion in the Background can be more easily understood by reference to these figures. The boresight alignment method and apparatus used in the TADS is a result of refining and improving these systems.

Figure 4:
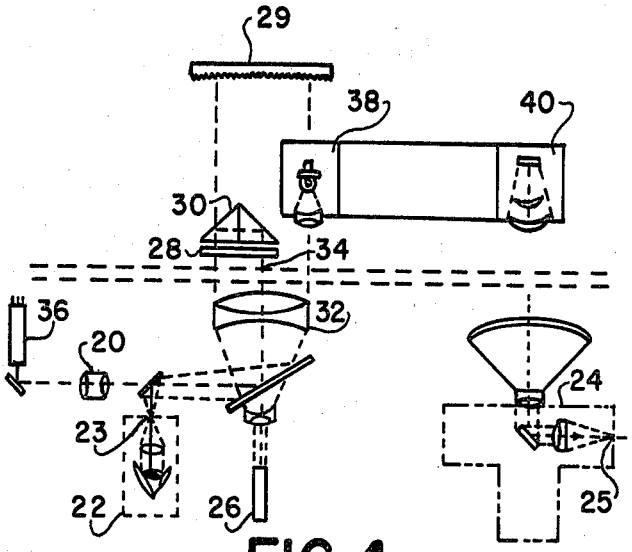
FIG. 4 PRIOR ART
FIG. 4 is a schematic diagram disclosing an initial attempt at implementing the basic principles of a boresight alignment device for the Target Acquisition Designation System (TADS)

Apparatus initially proposed for implementing the basic boresight alignment requirements for the TADS but subsequently abandoned due to inaccuracies introduced by helicopter vibrations, is shown in FIG. 4. The TADS requires precision alignment of the TV sight (consisting of multimode optics 32, relay optics 20, camera 36, electronics, and display not shown), Direct View Optics (DVO) 22, and Forward Looking Infrared (FLIR) sights 24 with respect to a high peak power Laser Rangefinder/Designator (LRF/D) 26. The FIG. 4 system achieves boresighting of the TADS by retroreflecting energy from laser 26, through cube corner prism 30. A diffuse black surface 29 catches the excess radiation from laser 26. Cube corner prism 30 redirects the energy from attenuator 28 to multimode optics 32, along a path generally indicated by line 34. The day TV aim reticle and autotracker electronic null are aligned on this redirected energy from the laser 26. The TV autotracker then locks onto signals from the TV camera 36 generated by a visual source 38. Transfer of the TV boresighting to the DVO 22 and FLIR 24 is accomplished by aligning their respective aim reticles 23 and 25 to corresponding collimators, visual source 38 and parallel IR source 40 while the visual source 38 is being tracked by the TV camera 36. However, a limitation surfaced in that helicopter vibration prevent accurate TV tracking of the visual source 38, resulting in inaccurate boresighting of the FLIR and DVO.

Figure 5:
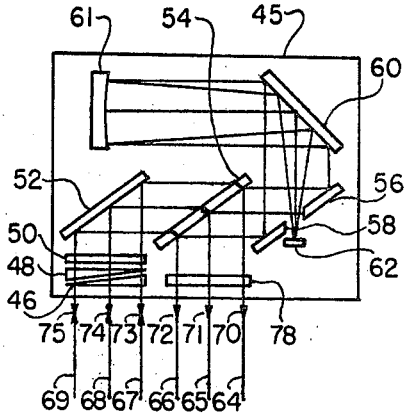
FIG. 5 is a schematic of a preferred embodiment for the TADS boresight module.

Thus, a different and preferred optical arrangement, shown in the schematic of FIG. 5, was adopted to eliminate the boresight error due to flight dynamics by aligning on a nearly instantaneous pulse of radiant power from a hot spot generated by focusing the laser beam on a refractory target material. The signals from this hot spot are of such short duration that the blurring due to motion of the module 45 is negligible. The 1.06 micrometer designator laser projects a beam through the port containing two wedge alignment windows 46 & 48 (FIG. 5) and a laser attenuating filter 50. The alignment windows 46 and 48 are rotatable Risley prism type optical wedges. The filter 50 reduces the intensity of the beam to a level that optimizes the return signals and maximizes the life of the laser target 62. The collimated beam, folded via reflector 52, passes through a dichroic beam splitter 54 off of a second fold mirror 56 with an annular hole 58. A third fold mirror 60 redirects the beam to reflector 61, which focuses the beam as shown and returns it to the third fold mirror 60. The focused beam is directed by mirror 60 through aperture 58 in the second fold mirror 56 and impacts onto a target 62. The laser energy creates a small bright hot flash on the target 62 that radiates as a black body visible in all three TADS sights. This energy then reverses its path and propogates back through the boresight module, and exits along lines 64-69 in the direction indicated by arrows 70-75. The dichroic beamsplitter 54 reflects a portion of the energy, the 7.5 to 12 micrometer wave length band, through germanium window 78 to the FLIR as shown by lines 64, 65 & 66. The remaining portion of the energy, the visible and near infrared, is folded out to the TV and DVO along lines 67, 68 & 69 through the same port as the laser input. The DVO reticle is then manually aligned to coincide with the laser hot flash spot center with a thumbforce controller, while electronic reticles are aligned to the flash in the TV and the FLIR either manually with the thumbforce controller or automatically by video autotracker electronics. After boresighting, whether statically or in flight, the sights are used to precisely designate targets by placing the boresighted aim reticles on the desired weapon hit point.

Many candidate materials were tested for target 62, but the refractory ceramics proved to be best. The target must be a low expansion coefficient, refractory material with low thermal diffusivity (conductivity divided by heat capacity), which is minimally damaged by about 3 millijoules of laser energy focused by the f/6 boresight device optics. Alumina (85% $AL^{203}$+10% $SiO_2$) had the longest life, but due to its high thermal conductivity, the FLIR hot flash signal was weak. Mullite (60% $AL^{203}$+38% $SiO_2$) was chosen as the preferred material, since it has a melting temperature of 1850° C. (3400° F.) and has excellent resistance to thermal shock, reproducible surface characteristics, and desired thermal properties. Experience shows that over 600,000 shots to target 62 did not degrade the Mullite. Sintered carbon is also a suitable target material.

At the same focal plane as the laser target 62 on a solenoid actuated arm (but not shown in the drawings) is a wedge-type resolution pattern on a zinc selenide substrate, back-lighted with small lamps. They illuminate and heat a diffuser glass, providing a focus test target for the DVO, TV and FLIR sights.

The design of the TADS and the boresight module are such that the boresight accuracy of the TV and DVO are unaffected by small shifts of the boresight module optical components, and the FLIR boresight accuracy is affected only by relative tilt between the first fold mirror 52 and the beamsplitter 54, which form an optical rhomboid. The rhomboid spacer and telescope framework are made of invar and semikinematically mounted to minimize thermomechanical distortions of the rhimboid section.

Figure 6:
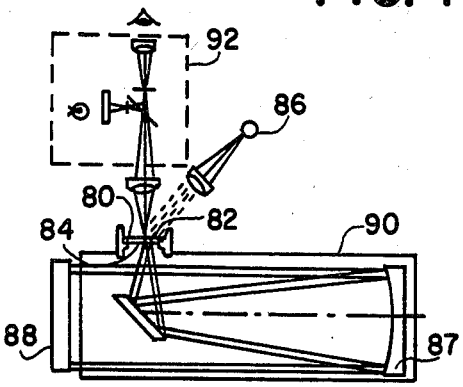
FIG. 6 is a schematic of a collimator autocollimation focusing procedure, the first step in aligning the TADS boresight module.
Figure 7:
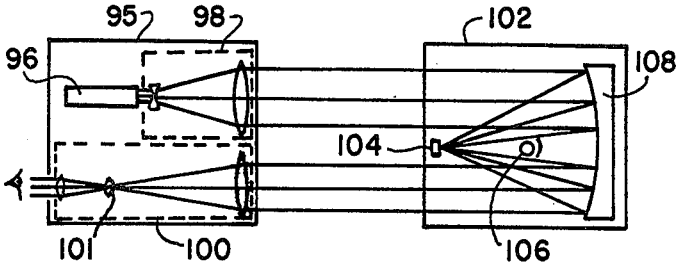
FIG. 7 is a schematic of the second step in aligning the TADS boresight module, alignment of the alignment fixture's visual telescope to it's $CO_2$ laser using the focused collimator.
Figure 8:
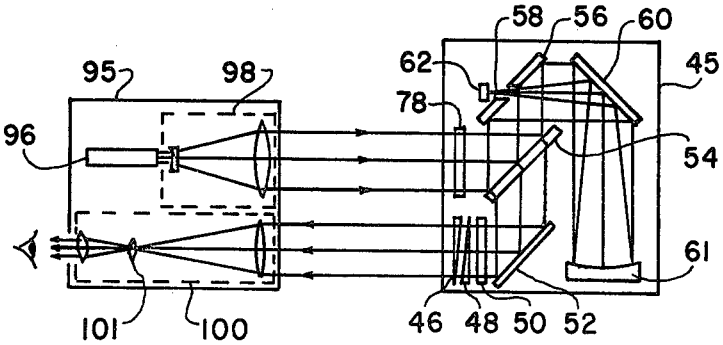
FIG. 8 is a schematic of the third step in aligning the TADS boresight module, adjustment of the wedge windows for zero boresight error using the alignment fixture.

A detailed breakdown of the critical optical alignment procedures is given in FIGS. 6-8 to show focus and alignment of the TADS boresight module 45. To obtain the accuracy required involves a three step procedure. Step 1: An all-reflective collimator is precisely focused to infinity by autocollimation off a flat mirror as dipicted in FIG. 6. Step 2: An alignment fixture, consisting of a $CO_2$ laser, beam expander telescope and a visual alignment telescope is adjusted using collimator 90, now modified to become 104 as shown in FIG. 7, so that both telescopes are focused to infinity and the line of sight of the visual telescope is accurately parallel to the projected laser beam. Step 3: The boresight module is then focused an aligned, using the alignment fixture thus adjusted as shown in FIG. 8, by axial adjustment of its target for best focus, and by rotating its alignment wedges and so that its visible and infrared optical paths are precisely parallel. The boresight module is now ready to be mounted (above the dashed lines in FIG. 4), and used to boresight, a military laser designator system with TV and/or visual sights coaxial with a 1.06 micrometer YAG laser and a separate aperture thermal imaging sight (commonly called a FLIR). A more detailed description of the three alignment steps will now be given, with numerical reference to the figures.

The focus of the module 45 is ultimately accomplished because a 51-inch all reflective collimator that is first precisely focused by autocollimation. (Step 1). FIG. 6 shows the focusing approaches. The approximate focus and alignment of the collimator and autocollimating mirror 88 are accomplished with a special half-clear 80 and half-fine ground glass 82 reticle 84, having a fine mark at the middle of the intersection. Flooding this with light 86, the diffuse section 82 scatters light both backwards and forwards. The edge of the inverted return image, reflected via mirrors 87 and 88 are aligned within the collimator unit 90. This method eliminates preliminary alignment problems due to the narrow field-of-view of the Abbe-Lamont microscope 92. When the lower surface of the glass reticle is at the infinity focal plane of the alignment collimator 90 and the Abbe-Lamont microscope system 92 is properly adjusted, coincident focused images are seen reflected from the autocollimating mirror and the bottom surface 84 of the glass reticle 84 through the microscope system 92. The infinity focus is precisely determined with this system. The collimator focal plane position is then locked and sealed so that when the glass reticle 80 is replaced with imaging disk 104 is at the infinity focus thus determined. The extreme accuracy of focus of the 51-inch collimator is required to yield the high precision in parallelism of the two input/output beams. The autocollimating mirror 88 was removed and the boresight module, with the cover off, was nominally aligned to the collimator and the reticle was back lighted. By viewing through the microscope 92 the best focus of the back-lighted boresight module reticle is determined.

An alignment fixture 95, consisting of a $CO_2$ laser 96 (10.6 micrometer), a 20X beam expander telescope 98, and a visual alignment telescope 100, all mounted on a rigid base plate, is aligned as shown in FIG. 7 (Step 2). To align the $CO_2$ laser 96 to the beam expander 98, a small thermopile probe attached to a millivolt meter can be scanned across the output while the input beam is angularly aligned. This provides an optimum Quasi-Gaussian $CO_2$ laser beam centered within the aperture. The 51-inch collimator 108 is positioned within collimating unit 102 as a common collimator for the IR and visual lines of sights. The collimator 108 is the same as collimator 90 shown in FIG. 6 except that an imaging disc 104 and excitation lamp 106 have been added to the field. The collimator unit 102 has the small thermal imaging disk 104 substituted at the infinity focus in place of the glass reticle 84 (FIG. 6), and its presence. A radiation field created by an ultraviolet phosphor exciting lamp 106 causes the disk to phosphoresce. The disk material 104 is a thermall sensitive phosphor that fluoresces when illuminated by long wavelength ultraviolet light (3600° A) but the intensity of the fluorescence decreases with increasing temperature. IR laser beams appear as a dark image on a bright background. Different sensitivity ranges are obtained by different phosphors and by varying the amount of thermal insulation between the phosphors and the anodized aluminum heat sink. These disks are commercially available. When the laser beam is focused onto the disk 104, its radiation heats the phosphor and extinguishes the phosphorescence. The laser beam is thus visible as a dark spot, which the observer sees through the visual telescope 100. A set of selected thin plastic attenuating filters (not shown) permit adjustment of the laser beam intensity, supplementing the laser current control. With the laser line of sight fixed, the alignment telescope 100 is adjusted to superimpose its reticle 101 onto the spot. This step completes the alignment of fixture 95.

With its cover in place, the boresight module 45 is substituted for the 51-inch collimator 102 in front of the alignment fixture 95, as shown in FIG. 8. Its internal alignment is achieved by rotation of the set of alignment wedges 46 and 48 (Step 3). First, the module 45 is nominally aligned to the alignment telescope 100 by viewing the modules back-lighted reticle (not shown but positioned at target 62 as discussed above). Actuation of a solenoid inserts the laser target 62 in place of the reticle. The $CO_2$ laser 96 provides CW power focused on the ceramic target 62 which generates a glowing hot spot visible in the alignment telescope 100. The wedge windows 46 and 48 are rotated to superimpose the hot spot on the telescope reticle 101. Locking the wedges 46 and 48 and potting completes the focus and alignment of the boresight module 45.

Thus, boresighting methods and apparatus have been described which permit relatively simple but accurate alignment of the day TV, Direct View Optics and Forward Looking Infrared Sights to the 1.06 micrometer laser designator used in the Target Acquisition Designation System. Two embodiments have been disclosed but variations and modifications will be apparent to those skilled in the art, with the true spirit and scope of the invention being limited only by the following claims.

I claim:

1. In the apparatus for boresighting laser designator/-ranger devices wherein radiation from a phosphorescent refractory target is collimated and projected by boresight optics for precision alignment of the laser designator device, the improvement eliminating long-term boresighting errors due to changes in mechanical and electrical boresight components comprising:

a boresight module having
- a germanium laser IR window,
- a visual alignment window,
- optical paths leading from each window for focusing and aligning,
- an internal refractory target capable of generating visible radiation in response to laser energy;
- a plurality of adjustable prism wedge windows for aligning the boresight module optical paths to said visible radiation;

a collimator unit containing
- a glass reticle capable of being removed,
- a fold mirror,
- a parabolic mirror, and
- an autocollimating mirror,
  - each adapted to direct light in a path from the fold mirror, to the parabolic mirror, to the autocollimating mirror and back, and the glass reticle adapted to produce both a visual image and a reflected image;
- means positioning said glass reticle in the collimator infinity focal plane by coincident focusing of these two images;
- means for securing a phosphorescent ceramic target in said focal plane within the collimator in lieu of the glass reticle;
- means within the collimator for exciting said ceramic target to phosphorescence;

an alignment fixture containing a laser beam source and a visual alignment telescope, capable of being set parallel to each other;

means for selecting the autocollimating mirror of the collimator unit with said alignment fixture;

means for focusing the alignment fixture on the collimator phosphorescent ceramic target and for concomitantly aligning the lines of sight of the visual alignment telescope thereon to obtain parallelism between the laser beam and the alignment telescope lines of sight within alignment fixture;

means in front of the parallelized alignment fixture for replacing the collimator with the boresight;

means for axially adjusting the target and for rotating the prism optical wedges within the boresight to align all optical systems of the boresight directly to the alignment fixture laser beam; and means for locking the optical wedges to set the focus and alignment of the boresight module so that the module is ready for boresighting the laser designator/ranger device.

2. A method for boresighting laser designator/ranger devices utilizing a boresight module having both visual and IR windows, optical paths from the windows for focusing and aligning, an internal refractory target capable of generating visible radiation in response to laser energy, and a plurality of adjustable prism wedge windows for aligning the optical paths, comprising: securing a phosphorescent ceramic target in the infinity focal plane of a collimator containing a parabolic mirror, a fold mirror and an autocollimating mirror, each adapted to direct light in a path from the fold mirror, to the parabolic mirror, to the autocollimating mirror and back to locate said infinity focal plane; exciting the ceramic target to phosphorescence; focusing on said phosphorescent target an alignment fixture containing a laser beam source and a visual alignment telescope, capable of being set parallel to each other; concomitantly aligning the lines of sight of the visual alignment telescope on the phosphorescence to obtain parallelism between the laser beam source and the alignment telescope lines of sight; then, by using the alignment fixture, aligning the optical systems of the boresight, axially adjusting the boresight internal refractory target and rotating the prism wedges to achieve said alignment; and locking the optical wedges to set the focus and alignment of the boresight module so that the module is ready for boresighting the laser designator/ranger device.

* * * * *